US009988838B2

(12) United States Patent
Chen et al.

(10) Patent No.: US 9,988,838 B2
(45) Date of Patent: Jun. 5, 2018

(54) TDBU WINDOW COVERING WITH CARRIAGE STRUCTURE

(71) Applicant: NIEN MADE ENTERPRISE CO., LTD., Taichung (TW)

(72) Inventors: Lin Chen, Taichung (TW); Keng-Hao Nien, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 0 days. days.

(21) Appl. No.: 15/254,433

(22) Filed: Sep. 1, 2016

(65) Prior Publication Data

US 2017/0067287 A1 Mar. 9, 2017

(30) Foreign Application Priority Data

Sep. 8, 2015 (CN) ..... 2015 2 0689929 U

(51) Int. Cl.
*E06B 9/323* (2006.01)
*E06B 9/322* (2006.01)
*E06B 9/262* (2006.01)

(52) U.S. Cl.
CPC ..... *E06B 9/323* (2013.01); *E06B 9/322* (2013.01); *E06B 2009/2627* (2013.01); *E06B 2009/3222* (2013.01)

(58) Field of Classification Search
CPC ... E06B 9/323; E06B 9/322; E06B 2009/3222
See application file for complete search history.

(56) References Cited

U.S. PATENT DOCUMENTS 7,331,370 B1 * 2/2008 Militello ..... E06B 9/322 160/170
2004/0177933 A1 * 9/2004 Hillman ..... E06B 9/322 160/170
2007/0125505 A1 * 6/2007 Liang ..... E06B 9/262 160/170
2007/0284060 A1 * 12/2007 Liang ..... E06B 9/32 160/170
2008/0277076 A1 * 11/2008 Cheng ..... E06B 9/322 160/167 R
2009/0173459 A1 * 7/2009 Hsu ..... E06B 9/322 160/331
2014/0069592 A1 * 3/2014 Hsu ..... E06B 9/38 160/84.05

(Continued)

FOREIGN PATENT DOCUMENTS

EP 2295702 A2 * 3/2011

*Primary Examiner* — Blair M Johnson
(74) *Attorney, Agent, or Firm* — R. Lynette Wylie; Apex Juris, pllc.

(57) ABSTRACT

A TDBU (top down, bottom up) window covering includes a first crossbeam and a second crossbeam below a fixture, wherein a slat assembly is connected between the first crossbeam and the second crossbeam. A first control structure is further provided in the first crossbeam, and a second control structure is provided in the second crossbeam. The first control structure moves the first crossbeam toward or away from the fixture, and the second control structure moves the second crossbeam toward or away from the first crossbeam. Whereby, the assembling and the maintenance of the window covering are more convenient and easier.

10 Claims, 7 Drawing Sheets

(56) References Cited

U.S. PATENT DOCUMENTS

| | | | | |
|---|---|---|---|---|
| 2014/0158314 | A1* | 6/2014 | Anderson | E06B 9/322<br>160/368.1 |
| 2015/0211294 | A1* | 7/2015 | Shih | E06B 9/262<br>160/168.1 R |
| 2015/0218879 | A1* | 8/2015 | Anderson | E06B 9/388<br>49/465 |
| 2016/0208549 | A1* | 7/2016 | Chen | E06B 9/322 |
| 2017/0067287 | A1* | 3/2017 | Chen | E06B 9/322 |

* cited by examiner

TDBU WINDOW COVERING WITH CARRIAGE STRUCTURE

BACKGROUND OF THE INVENTION

1. Technical Field

The present invention relates generally to a structure of a window covering, and more particularly to a TDBU (top down, bottom up) window covering which has a carriage structure.

2. Description of Related Art

A conventional TDBU (top down, bottom up) window covering includes a headrail, a middle rail, and a bottom rail, wherein a slat assembly is provided between the middle rail and the bottom rail. The conventional TDBU window covering uses two cords to move the middle rail toward the headrail or the bottom rail (i.e., the middle rail is movable in two directions), and uses other two cords to move the bottom rail toward or away from the middle rail, whereby the area shaded by the TDBU window covering could be changed at will.

However, two sets of reeling unit of a conventional TDBU window covering used for winding up the cords are installed in the headrail, which has very limited inner space to accommodate all of these components, and therefore the two sets of reeling units may interfere with each other. In other words, such arrangement is inconvenient and burdensome for assembling and even maintenance.

BRIEF SUMMARY OF THE INVENTION

In view of the above, the primary objective of the present invention is to provide a TDBU (top down, bottom up) window covering which has a carriage structure. An area shaded by the provided TDBU window covering could be adjusted, and the TDBU window covering could be easily assembled or maintained.

The present invention provides a TDBU (top down, bottom up) window covering which has a carriage structure, and is installed at a fixture. The TDBU window covering includes a first crossbeam, a second crossbeam, a slat assembly, a first control structure, and a second control structure. The first crossbeam is below the fixture. The second crossbeam is below the first crossbeam. An end of the slat assembly is connected to the first crossbeam, while another end thereof is connected to the second crossbeam. The first control structure is provided in the first crossbeam, wherein the first control structure includes a first carriage and a first pulling cord. The first carriage is movable back and forth in the first crossbeam along with the first crossbeam being moved toward or away from the fixture. An end of the first pulling cord passes by the first carriage, and another end thereof passes through the first crossbeam to be fixedly connected to the fixture. The second control structure is provided in the second crossbeam, wherein the second control structure includes a second carriage and a second pulling cord. The second carriage is movable back and forth in the second crossbeam along with the second crossbeam being moved toward or away from the first crossbeam. An end of the second pulling cord passes by the second carriage, and another end thereof passes through the second crossbeam to be fixedly connected to the fixture.

In an embodiment, the first control structure includes a first reel, a first prestressing device, and a first connecting cord. The first reel is provided in the first crossbeam and rotatable clockwise and counterclockwise. The first prestressing device drives the first reel to rotate. Ends of the first connecting cord are respectively fixedly connected to the first reel and the first carriage, wherein the first connecting cord winds around the first reel along with a rotation of the first reel. The first connecting cord is released from the first reel along with a reversed rotation of the first reel. When the first crossbeam is moved away from the fixture, the first pulling cord pulls the first carriage to reversely rotate the first reel.

In an embodiment, an end of the first reel is connected to a first active gear. The first prestressing device includes two first spools and a first torsion spring, wherein an end of one of the first spools is connected to a first driven gear, and the first driven gear meshes with the first active gear. Two ends of the first torsion spring are respectively connected to the first spools, and the first torsion spring is switchable to wind around one of the first spools along with a change of a rotational direction of the first spools.

In an embodiment, the first reel is cone-shaped, and is vertically and pivotally provided in the first crossbeam, with a wide side at top and a narrow side at bottom.

In an embodiment, the first control structure includes a first steering wheel and a first cord divider. The first steering wheel is fixed in the first crossbeam, and abuts against the first pulling cord. The first cord divider is provided on the first carriage. The first pulling cord passes by the first steering wheel and the first cord divider.

In an embodiment, the second control structure includes a second reel, a second prestressing device, and a second connecting cord. The second reel is provided in the second crossbeam and rotatable clockwise and counterclockwise. The second prestressing device drives the second reel to rotate. Ends of the second connecting cord are respectively fixedly connected to the second reel and the second carriage, wherein the second connecting cord winds around the second reel along with a rotation of the second reel. The second connecting cord is released from the second reel along with a reversed rotation of the second reel. When the second crossbeam is moved away from the first crossbeam, the second pulling cord pulls the second carriage to reversely rotate the second reel.

In an embodiment, an end of the second reel is connected to a second active gear. The second prestressing device includes two second spools and a second torsion spring, wherein an end of one of the second spool is connected to a second driven gear, and the second driven gear meshes with the second active gear. Two ends of the second torsion spring are respectively connected to the second spools, and the second torsion spring is switchable to wind around one of the second spools along with a change of a rotational direction of the second spools.

In an embodiment, the second reel is cone-shaped, and is vertically and pivotally provided in the second crossbeam, with a wide side at top and a narrow side at bottom.

In an embodiment, the second control structure includes a second steering wheel and a second cord divider. The second steering wheel is fixed in the second crossbeam, and abuts against the second pulling cord. The second cord divider is provided on the second carriage. The second pulling cord passes by the second steering wheel and the second cord divider.

In an embodiment, the fixture is an upper crossbeam above the first crossbeam. An end of another slat assembly is connected to the upper crossbeam, while another end of the another slat assembly is connected to the first crossbeam.

In an embodiment, the second pulling cord passing through the second crossbeam passes through the first crossbeam before being fixedly connected to the fixture, and a segment of the second pulling cord in the first crossbeam abuts against or passes by a wheel. The second pulling cord passes through the first crossbeam along with the first pulling cord passing through the first crossbeam to be fixedly connected to the fixture together.

Since the first control structure and the second control structure could be installed respectively in the first crossbeam and the second crossbeam which are controllable to be raised or lowered, the assembling and maintenance of the TDBU window covering would become easier and more convenient.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
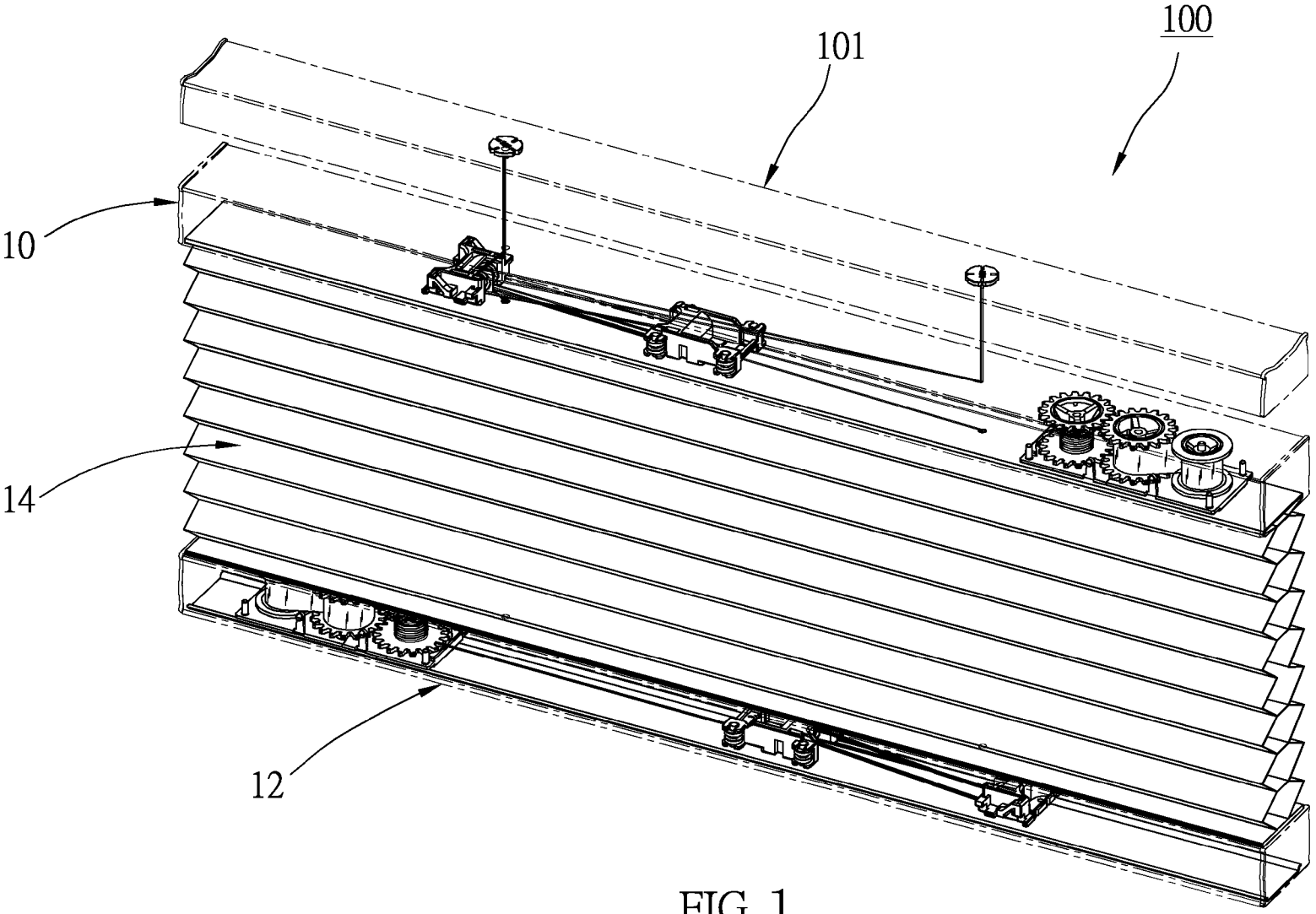
FIG. 1 is a perspective view of a first embodiment of the present invention.

A TDBU (top down, bottom up) window covering 100 of the first embodiment of the present invention is illustrated in FIG. 1, which is installed on a fixture to shade an opening (e.g., a window) of a building. Said fixture has a fixed crossbeam, a window frame, or other firm and rigid structures. In the first embodiment, the fixture is an upper crossbeam 101 fixed on a top margin of the opening of the building.

The TDBU window covering 100 includes a first crossbeam 10, a second crossbeam 12, a slat assembly 14, a first control structure, and a second control structure. The first crossbeam 10 is located below the upper crossbeam 101, and the second crossbeam 12 is located below the first crossbeam 10, wherein the slat assembly 14 is connected to the first crossbeam 10 with an end thereof, and is connected to the second crossbeam 12 with another end thereof. The slat assembly 14 provides a good shading effect, which could be various types of slats, and is not necessary to be a cellular shade as shown in the first embodiment. The first control structure is provided in the first crossbeam 10, and is adapted to move the first crossbeam 10 toward or away from the upper crossbeam 101. Similarly, the second control structure is provided in the second crossbeam 12, and is adapted to move the second crossbeam 12 toward or away from the first crossbeam 10. Since the first control structure and the second control structure have the same structures, herein we mainly take the first control structure for illustration, with the second control structure used for auxiliary explanation.

Figure 2:
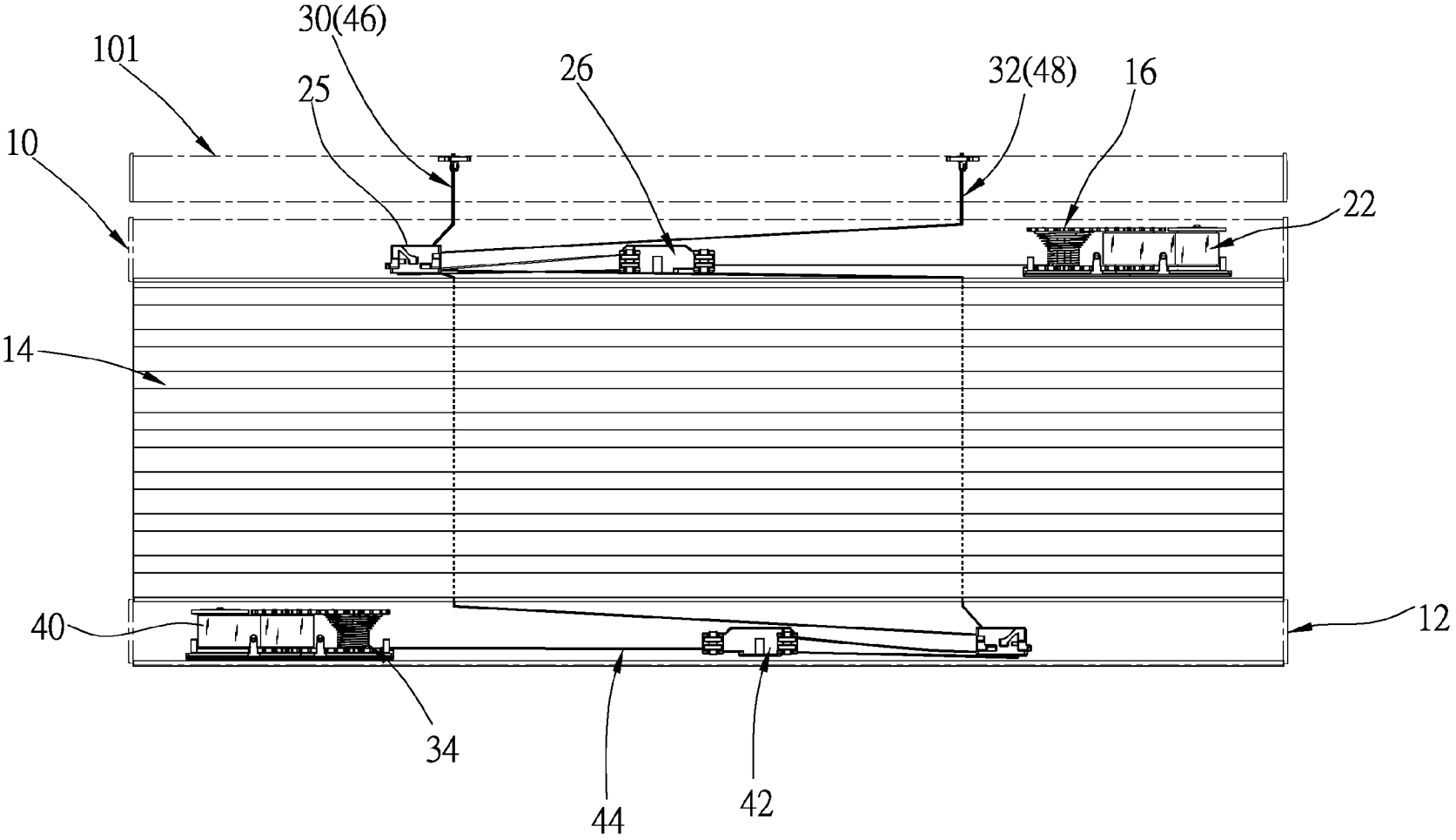
FIG. 2 is a front view of FIG. 1.
Figure 3:
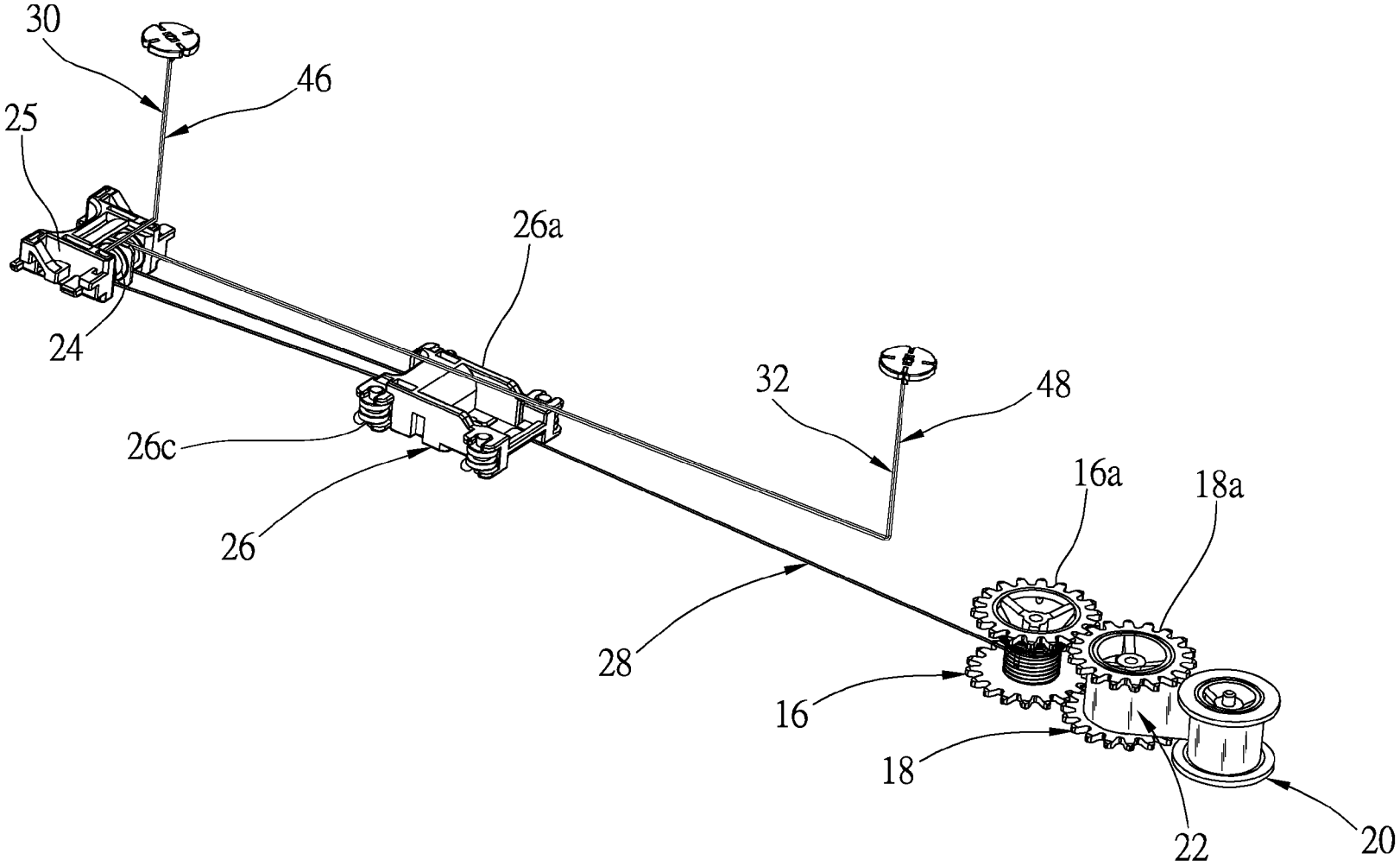
FIG. 3 and FIG. 4 are perspective views, showing the first control structure of the first embodiment of the present invention illustrated in FIG. 1.
Figure 4:
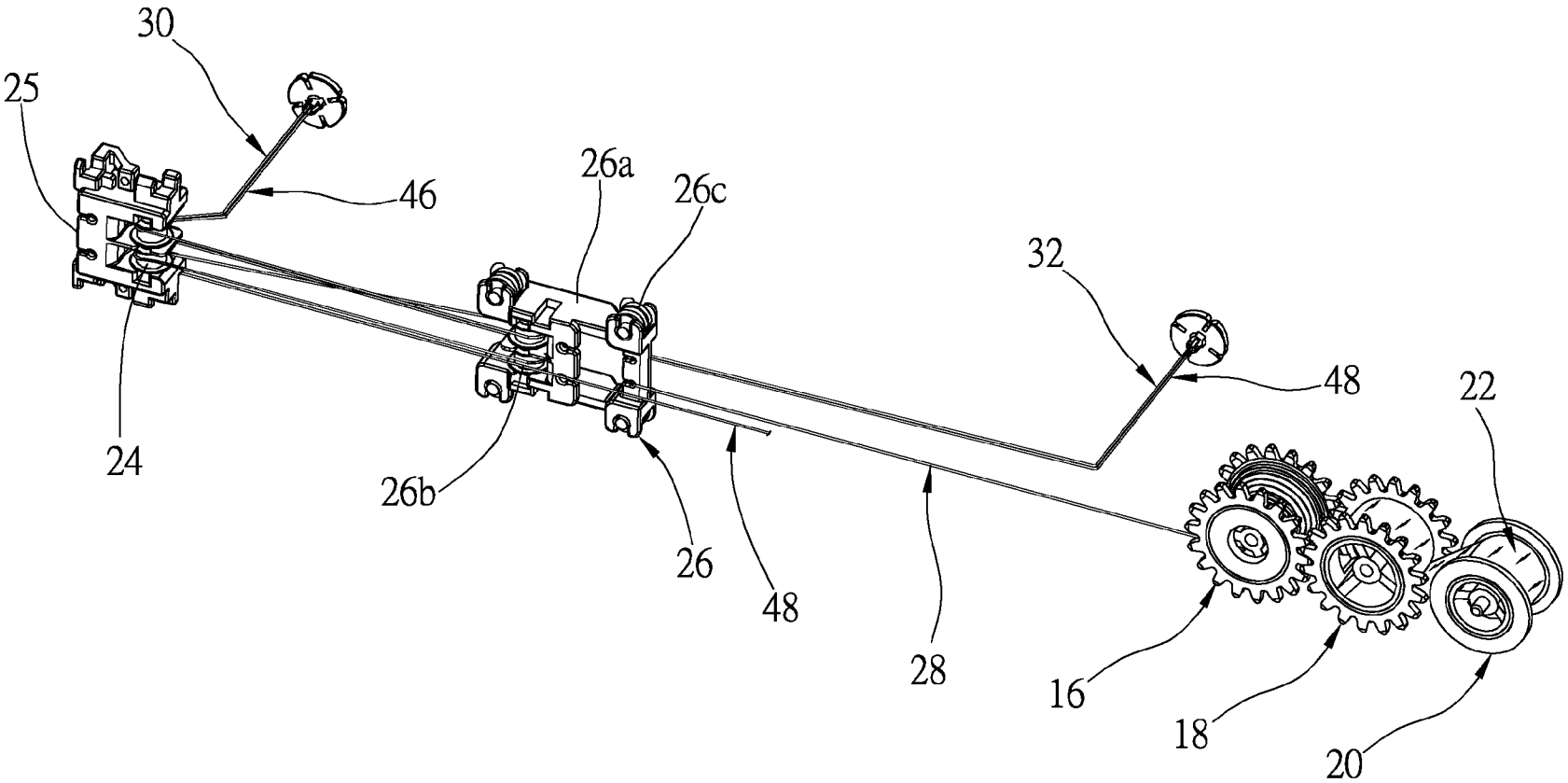

As shown in FIG. 2 to FIG. 4, the first control structure includes a first reel 16, a first prestressing device, a first steering wheel 24, a first carriage 26, a first connecting cord 28, and two first pulling cords 30 (32). The first reel 16 and the first prestressing device are installed on a side of the first crossbeam 10 in a longitudinal direction thereof, while the first steering wheel 24 is installed on another side of the first crossbeam 10 in the longitudinal direction. The first carriage 26 is located between the first reel 16 and the first steering wheel 24, and could be moved back and forth.

The first reel 16 is cone-shaped, which is vertically and pivotally provided on the first crossbeam 10, with a wide side at top and a narrow side at bottom. The first reel 16 is controllable to rotate clockwise or counter-clockwise. The first reel 16 is provided with a helical cord slot on a surface thereof, and a first active gear 16*a* is connected to a top and/or a bottom thereof. In the first embodiment, the cone-shaped contour of the first reel 16 gradually gets narrower from top to bottom, and has a straight segment (i.e., of which the diameter is constant) extending from the narrowest point. In other words, the contour of the first reel 16 looks like a funnel when seen from side. Of course, in other embodiments, the straight segment could be also completely omitted, or the cone-shaped structure of the first reel 16 could have an inwardly curved surface.

Figure 5:
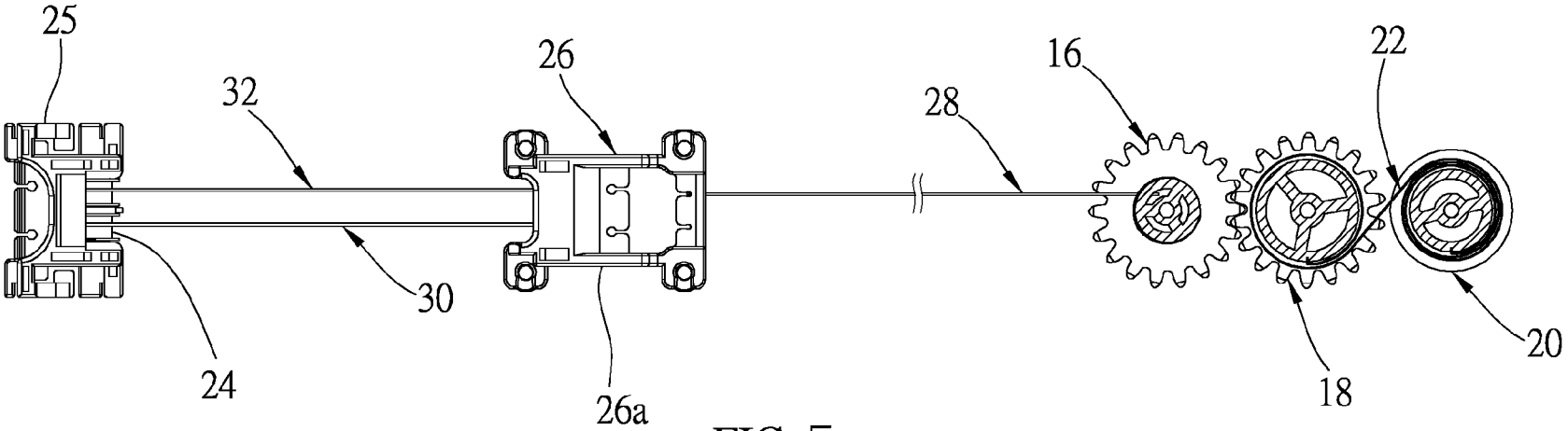
FIG. 5 is a top view of the first control structure in FIG. 3, showing the first carriage stays unmoved.

The first prestressing device is adapted to drive the first reel 16 to rotate clockwise, which includes two first spools 18 (20) and a first torsion spring 22. The first spools 18 (20) are rotatable, and adjacent to each other, wherein a first driven gear 18*a* is provided at a top and/or a bottom of the first spool 18. The first driven gear 18*a* meshes with the first active gear 16*a*. As shown in FIG. 5, two ends of the first torsion spring 22 are respectively connected to one of the first spools 18 (20), and the first torsion spring 22 could be switched to wind around the first spool 18 or the first spool 20 along with the change in rotational direction of the first spools 18 (20). As shown in FIG. 2 and FIG. 5, when in a normal condition, most of the first torsion spring 22 winds around the first spool 20. At this time, the pulling force generated by the first torsion spring 22 would keep the first reel 16 in a clockwise-rotating status through the first spool 18. Said normal condition refers to a collapsed condition, i.e., when the first crossbeam 10 is near the upper crossbeam 101.

The first steering wheel 24 is rotatably provided on an unmovable seat 25, and has two separated grooves. The first carriage 26 includes a main body 26*a*, a first cord divider 26*b*, and a plurality of guiding wheels 26*c*. The first cord divider 26*b* is connected to a lower portion of the main body 26*a*, and has two separated grooves. The guiding wheels 26*c* are pivotally provided on two sides of the main body 26*a*, wherein the guiding wheels 26*c* contact with an inner wall of the first crossbeam 10, so that the first carriage 26 could be smoothly moved back and forth relative to the first reel 16.

An end of the first connecting cord 28 is fixedly connected to the main body 26*a* of the first carriage 26, while another end thereof is fixedly connected to the first reel 16. The first connecting cord 28 would be wound around the first reel 16 along with the clockwise rotation of the first reel 16, which would reduce a distance between the first reel 16 and the first carriage 26. On the contrary, the first connecting cord 28 would be released from the first reel 16 along with the counter-clockwise rotation of the first reel 16, which increases the distance between the first reel 16 and the first carriage 26 (as shown in FIG. 6).

An end of each of the first pulling cords 30 (32) is fixedly connected to the main body 26*a* of the first carriage 26, while another end thereof passes through a bore on the first crossbeam 10 to be fixedly connected to the upper crossbeam 101. The first pulling cords 30 (32) respectively pass by the first cord divider 26*b* of the first carriage 26 and the first steering wheel 24, and respectively cross the first steering wheel 24 and one of the separated grooves on the first cord divider 26*b*, whereby the first pulling cords 30 (32) could be prevented from overlapping or twisting with each other. The purpose of providing the first steering wheel 24 and the first cord divider 26*b* described above is to change the "multiple" relation between the moving distances of the first carriage 26 and the first crossbeam 10 by setting the turning times of the first pulling cords. For example, if one first pulling cords sequentially passes by the first steering wheel 24, the first cord divider 26*b*, the first steering wheel 24 again, and then gets fixed onto the main body 26*a*, such a first pulling cord turns two times (i.e., it changes its direction for two times); at this time, if the first carriage 26 is moved over a certain distance, the first crossbeam 10 will be moved over three times of the distance. We could keep going on that, if the first pulling cord turns again before being fixedly connected to the unmovable seat 25, then the moving distance of the first crossbeam 10 would be the moving distance of the first carriage 26 times an even number.

The situation when the first crossbeam 10 is near the upper crossbeam 101 is shown in FIG. 2 and FIG. 5. At this time, the first prestressing device would keep the first reel 16 in a clockwise-rotating status. Meanwhile, part of the first connecting cord 28 would be orderly wound in the cord slot on the first reel 16 from the top toward the bottom thereof, which provides an increasing pulling force to the first carriage 26. Whereby, the first crossbeam 10 could be ensured to be positioned at an expected location.

Figure 6:
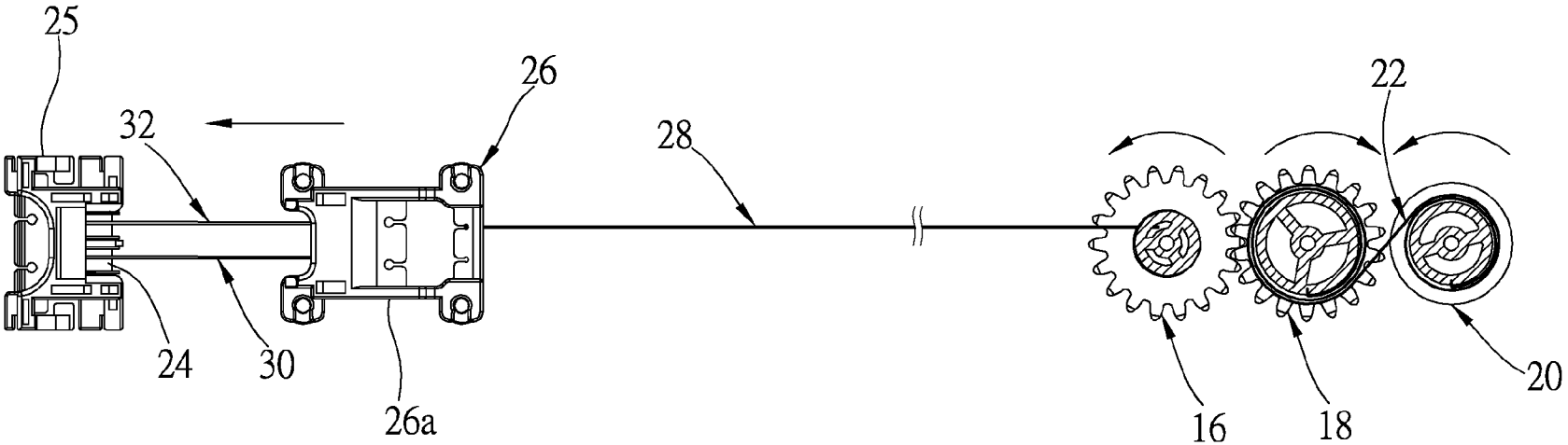
FIG. 6 is similar to FIG. 5, showing the first carriage is moved towards the left side.
Figure 7:
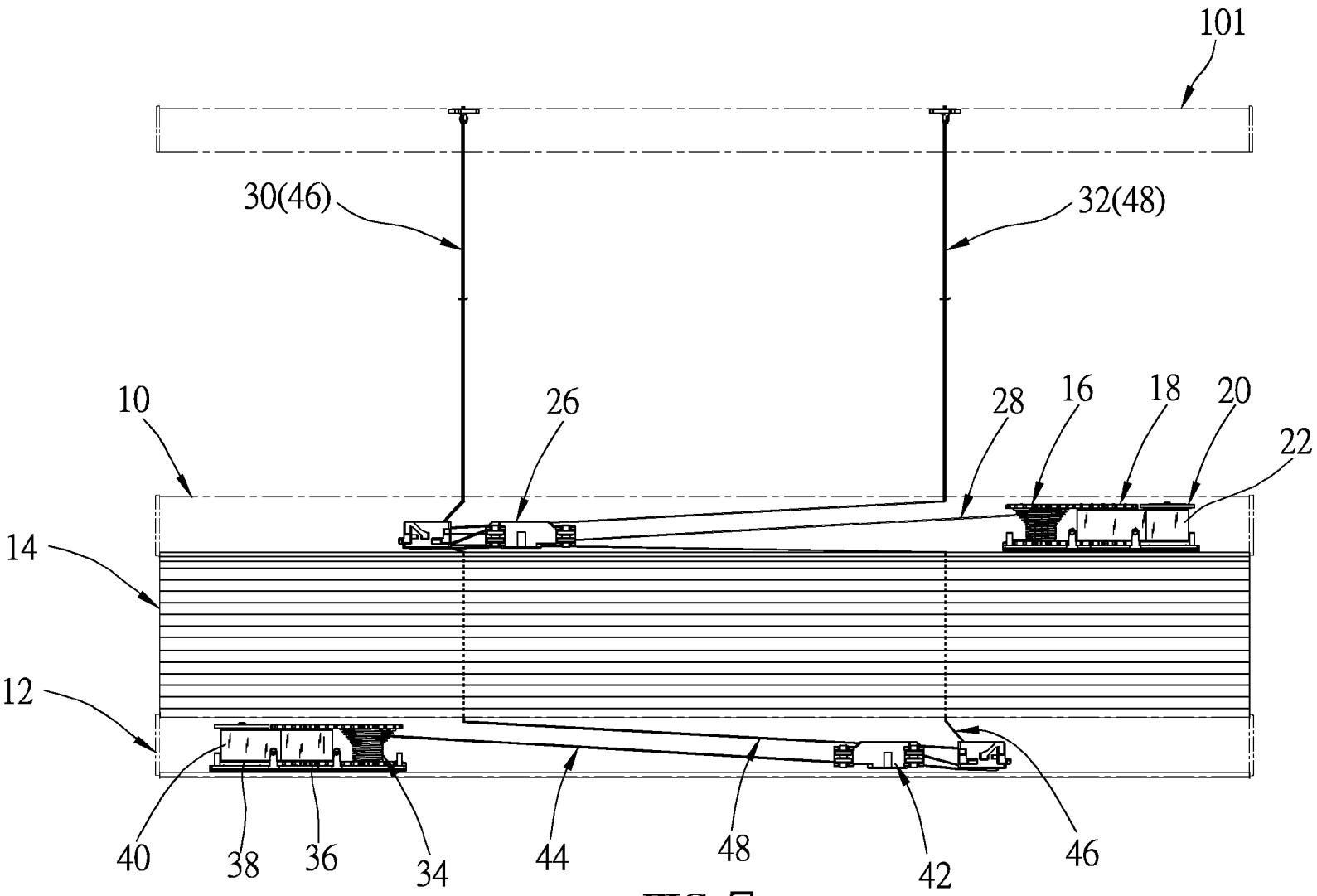
FIG. 7 is a front view, showing the first crossbeam and the second crossbeam are located low.

The situation when the first crossbeam 10 is being pulled downward and away from the upper crossbeam 101 is shown in FIG. 6 and FIG. 7. In such a situation, an upper part of the TDBU window covering 100 could be opened to allow light to pass through, while a bottom part thereof remains closed. While the first crossbeam 10 is moving downward relative to the upper crossbeam 101, the first carriage 26 would be pulled by the first pulling cords 30 (32) to move in a direction away from the first reel 16, and the first carriage 26 would pull out the first connecting cord 28 which winds around the first reel 16, which drives the first reel 16 to rotate counter-clockwise. As a result, the rotational direction of the first spools 18 (20) would be changed, causing most of the first torsion spring 22 to be switched to wind around the first spool 18. Whereby, when the first crossbeam 10 is moved upward, and the first torsion spring 22 automatically rewinds around the first spool 20, the pulling force generated by the automatic rewinding of the first torsion spring 22 would make the first crossbeam 10 draw near to the upper crossbeam 101 easier.

Therefore, the first carriage 26 would be moved back and forth in the first crossbeam 10 when the first crossbeam 10 is moved toward or away from the upper crossbeam 101. With the first prestressing device which has the first torsion spring 22, and the change of the position of the first connecting cord 28 on the cone-shaped body of the first reel 16, the outcome force exerted on the first carriage 26 would be changed, which would make the operation of the first crossbeam 10 more effortless. Furthermore, the first crossbeam 10 would be properly positioned without sinking.

As for the second control structure, which is adapted to move the second crossbeam 12 toward or away from the first crossbeam 10, it includes a second reel 34 same as the first reel 16 mentioned above, which also has a second active gear connected thereto as the first active gear 16*a* connected to the first reel 16, a second prestressing device same as the first prestressing device mentioned above, a second steering wheel (not shown) same as the first steering wheel 24 mentioned above, a second carriage 42 same as the first carriage 26 mentioned above, a second connecting cord 44 same as the first connecting cord 28 mentioned above, and two second pulling cords 46 (48), wherein the second prestressing device further includes two second spools 36 (38) same as the first spools 18 (20) mentioned above, and a second torsion spring 40 same as the first torsion spring 22 mentioned above; the second spool 36 also has a second driven gear provided thereon, as the first driven gear 18*a* provided on the first spool 18.

The components and the connection relation between the components contained in the second control structure are identical with those of the first control structure, except that an end of each of the second pulling cords 46 (48) passes through the slat assembly 14 first, and then the first crossbeam 10 to be firmly connected to the upper crossbeam 101, which is slightly different from the arrangement of the first pulling cord 30 (32). Since the operation and function provided by the second control structure are also the same with that provided by the first control structure, we are not going to describe the second control structure in details herein. However, it is worth mentioning that, when the second pulling cords 46 (48) pass through the first crossbeam 10 before being connected to the upper crossbeam 101, a segment of each of the cords abuts against or passes by a wheel, which is the first steering wheel 24 in the first embodiment. More specifically, each of the second pulling cords 46 (48) in the first embodiment passes by the first steering wheel 24 with the segment thereof first, and then passes through the upper crossbeam 101 along with the first pulling cord 30 (32) passing through the first crossbeam 10 to be fixed to the upper crossbeam 101. Such arrangement could prevent the second pulling cords 46 (48) from blocking the moving path of the first carriage 26, which might happen if the second pulling cords 46 (48) directly pass through the first crossbeam 10 to be connected to the upper crossbeam 101. Furthermore, the second crossbeam 12 could be provided with friction for positioning, and cord segments of the second pulling cords 46 (48) in the first crossbeam 10 would not get twisted with the first pulling cord 30 (32).

Figure 8:
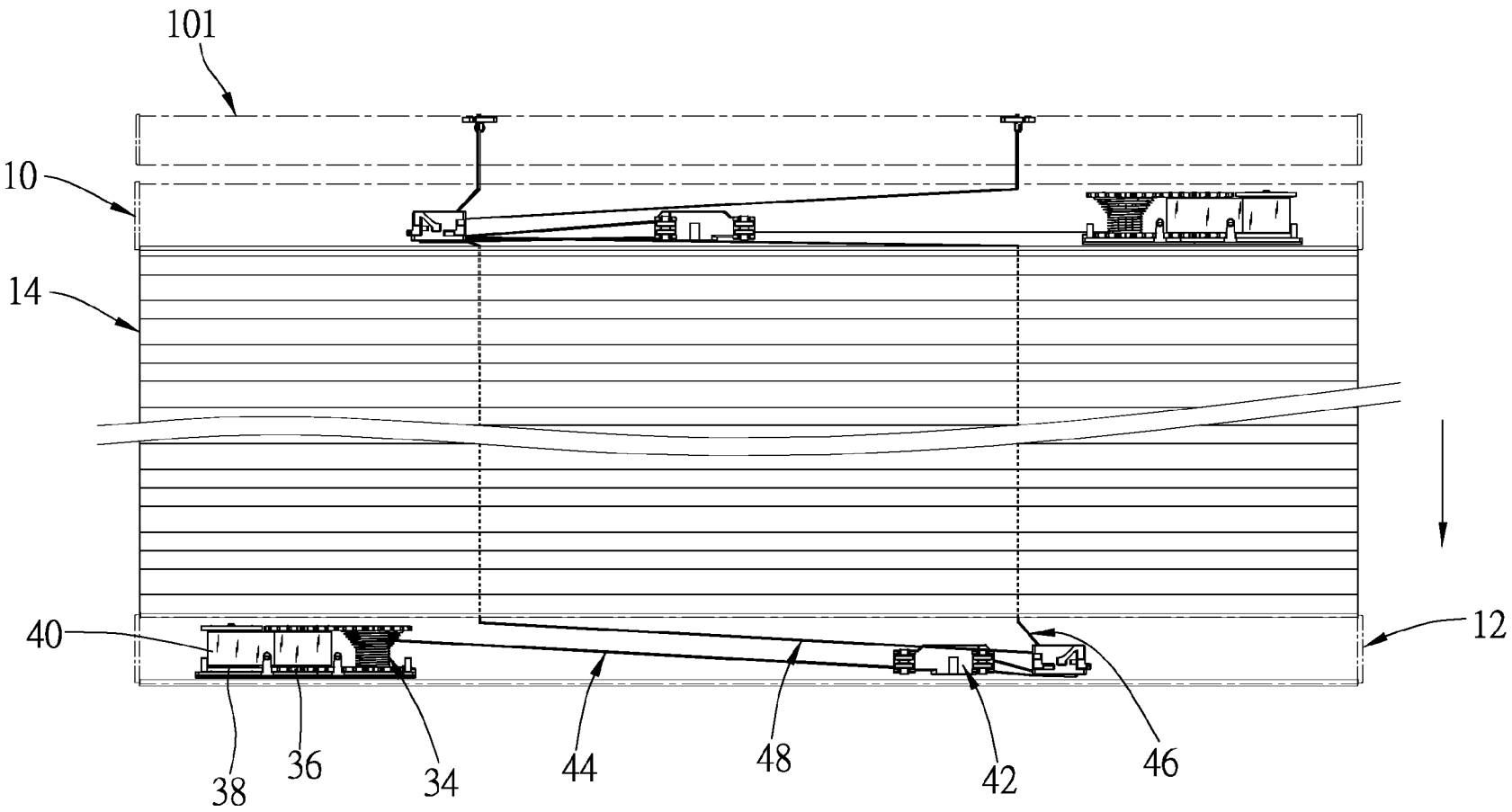
FIG. 8 is a front view, showing the first crossbeam is near the upper crossbeam, while the second crossbeam is located low.

The situation when the first crossbeam 10 and the second crossbeam 12 are moved downward together is illustrated in FIG. 7, and FIG. 8 shows that the second crossbeam 12 is remained to locate low, while the first crossbeam 10 is moved upward (i.e., toward the upper crossbeam 101). No matter where the first crossbeam 10 is, the second crossbeam 12 would always be controlled by the second control structure while being pulled downward, whereby the operation would be effortless. Furthermore, when the second crossbeam 12 is pushed upward and near the first crossbeam 10, the pulling force provided by the second prestressing device would balance the weight of the slat assembly 14 stacked on the second crossbeam 12, which could ensure the second crossbeam 12 to be properly positioned without sinking.

The TDBU window covering 100 could adjust a shaded area in the upper part or the lower part thereof. The first control structure and the second control structure are respectively installed in the first and the second crossbeams which are controllable to be raised or lowered, which benefits the assembling and the maintenance of the TDBU window covering 100. In addition, though the upper crossbeam 101, which is the fixture in the first embodiment, is also a part of the window covering, and therefore is sold along with all of the other components of the window covering, in practice, the upper crossbeam 101 could be omitted, and the TDBU window covering 100 is directly installed in a window frame. In other words, the window frame plays the role of the fixture. In such a case, instead of being connected to the upper crossbeam 101, the end of each of the first pulling cords 30 (32) and each of the second pulling cords 46 (48) should be directly connected to an upper edge of the window frame. In this way, the manufacturing cost could be further reduced.

It is worth mentioning that, another slat assembly could be further provided between the fixture (i.e., the upper crossbeam 101 or the window frame) and the first crossbeam 10 to meet different requirements, wherein an end of the another slat assembly is connected to the fixture, while another end thereof is connected to the first crossbeam 10. Preferably, the material or the structure of the another slat assembly are different from that of the aforementioned slat assembly 14. Whereby, the TDBU window covering 100 could provide different shading effect in the upper and the lower parts thereof.

It must be pointed out that the embodiments described above are only some preferred embodiments of the present invention. All equivalent structures which employ the concepts disclosed in this specification and the appended claims should fall within the scope of the present invention.

What is claimed is:

1. A TDBU (top down, bottom up) window covering, which has a carriage structure, and is installed at a fixture, comprising:

a first crossbeam below the fixture;

a second crossbeam below the first crossbeam;

a slat assembly, of which an end is connected to the first crossbeam, while another end thereof is connected to the second crossbeam;

a first control structure provided in the first crossbeam, wherein the first control structure comprises a first carriage and a first pulling cord; the first carriage is movable back and forth in the first crossbeam along with the first crossbeam being moved toward or away from the fixture; an end of the first pulling cord passes by the first carriage, and another end thereof passes through the first crossbeam to be fixedly connected to the fixture; and a second control structure provided in the second crossbeam, wherein the second control structure comprises a second carriage and a second pulling cord; the second carriage is movable back and forth in the second crossbeam along with the second crossbeam being moved toward or away from the first crossbeam; an end of the second pulling cord passes by the second carriage, and another end thereof pass through the second crossbeam to be fixedly connected to the fixture;

wherein the first control structure comprises a first steering wheel; the first steering wheel is fixed in the first crossbeam; the first pulling cord passes by or winds around the first steering wheel, and the second pulling cord passes by or abuts against the first steering wheel when passes through the first crossbeam;

wherein the first control structure comprises a first reel, a first prestressing device, and a first connecting cord; the first reel is provided in the first crossbeam and rotatable clockwise and counterclockwise; the first prestressing device drives the first reel to rotate; ends of the first connecting cord are respectively fixedly connected to the first reel and the first carriage, wherein the first connecting cord winds around the first reel along with a rotation of the first reel; the first connecting cord is released from the first reel along with a reversed rotation of the first reel; when the first crossbeam is moved away from the fixture, the first pulling cord pulls the first carriage to reversely rotate the first reel.

2. The TDBU window covering of claim 1, wherein an end of the first reel is connected to a first active gear; the first prestressing device comprises two first spools and a first torsion spring, wherein an end of one of the first spools is connected to a first driven gear, and the first driven gear meshes with the first active gear; two ends of the first torsion spring are respectively connected to the first spools, and the first torsion spring is switchable to wind around one of the first spools along with a change of a rotational direction of the first spools.

3. The TDBU window covering of claim 1, wherein the first reel is cone-shaped, and is vertically and pivotally provided in the first crossbeam, with a wide side at top and a narrow side at bottom.

4. The TDBU window covering of claim 1, wherein the first control structure comprises a first steering wheel; the first steering wheel abuts against the first pulling cord; the first cord divider is provided on the first carriage; the first pulling cord passes by the first cord divider.

5. The TDBU window covering of claim 1, wherein the second control structure comprises a second reel, a second prestressing device, and a second connecting cord; the second reel is provided in the second crossbeam and rotatable clockwise and counterclockwise; the second prestressing device drives the second reel to rotate; ends of the second connecting cord are respectively fixedly connected to the second reel and the second carriage, wherein the second connecting cord winds around the second reel along with a rotation of the second reel; the second connecting cord is released from the second reel along with a reversed rotation of the second reel; when the second crossbeam is moved away from the first crossbeam, the second pulling cord pulls the second carriage to reversely rotate the second reel.

6. The TDBU window covering of claim 5, wherein an end of the second reel is connected to a second active gear; the second prestressing device comprises two second spools and a second torsion spring, wherein an end of one of the second spool is connected to a second driven gear, and the second driven gear meshes with the second active gear; two ends of the second torsion spring are respectively connected to the second spools, and the second torsion spring is switchable to wind around one of the second spools along with a change of a rotational direction of the second spools.

7. The TDBU window covering of claim 5, wherein the second reel is cone-shaped, and is vertically and pivotally provided in the second crossbeam, with a wide side at top and a narrow side at bottom.

8. The TDBU window covering of claim 1, wherein the second control structure comprises a second steering wheel and a second cord divider; the second steering wheel is fixed in the second crossbeam, and abuts against the second pulling cord; the second cord divider is provided on the second carriage; the second pulling cord passes by the second steering wheel and the second cord divider.

9. The TDBU window covering of claim 1, wherein the fixture is an upper crossbeam above the first crossbeam; an end of another slat assembly is connected to the upper crossbeam, while another end of the another slat assembly is connected to the first crossbeam.

10. The TDBU window covering of claim 1, wherein the second pulling cord passing through the second crossbeam passes through the first crossbeam before being fixedly connected to the fixture, and a segment of the second pulling cord in the first crossbeam abuts against or passes by a wheel; the second pulling cord passes through the first crossbeam along with the first pulling cord passing through the first crossbeam to be fixedly connected to the fixture together.

* * * * *